US007500339B2

(12) United States Patent
Knuth et al.

(10) Patent No.: US 7,500,339 B2
(45) **Date of Patent: *Mar. 10, 2009**

(54) INTEGRATED CUTTING TOOL FOR WASTE DISPOSAL METHOD AND APPARATUS

(75) Inventors: Rosemary Knuth, Congers, NY (US); John Rousso, Trumbull, CT (US); Richard Chomik, Orlando, FL (US); John Cichello, Wooster, OH (US); David Hayes, Wooster, OH (US); Mark Yoho, Chagrin Falls, OH (US); Jim Simer, Concord Township, OH (US)

(73) Assignee: Playtex Products, Inc., Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/001,192

(22) Filed: Dec. 10, 2007

(65) Prior Publication Data

US 2008/0134644 A1 Jun. 12, 2008

Related U.S. Application Data

(63) Continuation of application No. 11/199,330, filed on Aug. 8, 2005, now abandoned, which is a continuation of application No. 10/770,872, filed on Feb. 3, 2004, now Pat. No. 6,925,781.

(51) Int. Cl.
*B65B 7/12* (2006.01)

(52) U.S. Cl. ..... 53/459; 53/469; 53/483; 53/576; 53/370

(58) Field of Classification Search ..... 53/459, 53/469, 483, 567, 570, 576, 577, 284.7, 370
See application file for complete search history.

(56) References Cited

U.S. PATENT DOCUMENTS

| | | | | |
|---|---|---|---|---|
| 3,321,103 | A * | 5/1967 | Phillips | 53/469 |
| 3,935,692 | A * | 2/1976 | Miller | 53/370 |
| 4,001,049 | A | 1/1977 | Baglin et al. | 250/492.3 |
| 4,374,391 | A | 2/1983 | Camlibel et al. | 357/17 |
| 4,492,717 | A | 1/1985 | Pliskin et al. | 438/618 |
| 4,855,026 | A | 8/1989 | Sioshansi | 204/192.11 |
| 4,869,049 | A | 9/1989 | Richards et al. | 53/459 |
| 4,889,960 | A | 12/1989 | Butt | 174/52.4 |
| 5,047,369 | A | 9/1991 | Fleming et al. | 438/779 |
| 6,111,270 | A | 8/2000 | Xu et al. | 257/72 |
| 6,128,890 | A | 10/2000 | Firth | 53/567 |
| 6,137,173 | A | 10/2000 | Davis | 257/730 |
| 6,370,847 | B1 * | 4/2002 | Jensen et al. | 53/459 |
| 6,925,781 | B1 | 8/2005 | Knuth et al. | 53/459 |
| 2002/0019069 | A1 | 2/2002 | Wada | 438/69 |
| 2004/0194433 | A1 * | 10/2004 | Chomik et al. | 53/459 |

(Continued)

FOREIGN PATENT DOCUMENTS

| | | |
|---|---|---|
| CH | 387175 | 5/1965 |

*Primary Examiner*—Stephen F Gerrity
(74) *Attorney, Agent, or Firm*—Ohlandt, Greeley, Ruggiero & Perle, LLP.

(57) ABSTRACT

The invention discloses a waste disposal apparatus including a waste packet forming device integrated with a tool for cutting the packet, and a method for using the apparatus. The disclosed integrated twist-and-cut system provides an improvement over existing waste disposal systems by reducing steps in the disposal of waste material.

21 Claims, 5 Drawing Sheets

U.S. PATENT DOCUMENTS

2005/0115207 A1 6/2005 Chomik ..... 53/459
2005/0183401 A1 8/2005 Stravitz ..... 53/567
2005/0244949 A1 11/2005 Miles ..... 435/287.1
2006/0010837 A1* 1/2006 Jurus ..... 53/469

* cited by examiner

INTEGRATED CUTTING TOOL FOR WASTE DISPOSAL METHOD AND APPARATUS

RELATED APPLICATIONS

This application is a continuation of, U.S. patent application Ser. No. 11/199,330, filed Aug. 8, 2005 now abandoned that is a continuation of U.S. patent application Ser. No. 10/770,872, filed Feb. 3, 2004 that has issued as U.S. Pat. No. 6,925,781, the disclosure of which are incorporated herein by reference.

FIELD OF INVENTION

The present invention relates generally to a waste disposal apparatus and a method for disposing waste material. More particularly, the present invention is directed to an apparatus having a cutting tool integrated with a mechanism for sealing a tubular sealing material containing waste, and to a method of using the waste disposal apparatus.

BACKGROUND OF INVENTION

Conventional waste disposal devices and systems are generally available to dispose waste ranging from kitchen refuse to soiled diapers. Most waste receptacles require separate and numerous actions for packing waste and disposing them.

European patent application No. 0005660 describes a device for disposing kitchen refuse in packages enclosed by flexible tubing derived from a tubular pack of tubing surrounding a tubular guide. The device includes a tube sealing mechanism. The tubing passes from the pack over the top of and then down the guide to a position beneath the guide where it has been closed by fusion to provide a receptacle within the guide means. When this receptacle is full of refuse, a lever is manually operated to actuate an electro-mechanical apparatus including clamping and fusion devices that travel round closed tracks to perform the four-fold task of drawing the receptacle down below the tubular guide, fusing the tubing walls together to seal the top of the receptacle, sealing the tubing walls together to provide the closed base of the next receptacle and dividing the tubing by heat at a location between these two fusion locations to separate the filled package.

A popular approach for disposing of diapers has been a device using, for example, a tube twisting mechanism to form a pouch about a diaper. Such a device is disclosed in U.S. Pat. No. 4,869,049. The patent discloses an apparatus to form packets containing disposable diapers comprising a tubing which passes through the top edges of a core opening and then down through the core. The core is turned by means of a twist ring/drive about a cylinder to twist the flexible material at locations between the adjacent packets to seal the packets at their ends thereby providing disposal of the waste. A manually rotatable cutter in the lid is provided for severing the flexible tubing above the twisted packets.

A commercially available waste storage device for disposal of baby diapers is known as the Playtex Diaper Genie®. In the Diaper Genie®, a waste storage container is fitted with a lid designed to contain odors when the lid is closed. The lid also has a rotatable cutting device designed to sever a storage film from a film cassette positioned in the waste container body. The film cassette having a hole concentrically located therein, is positioned in the waste container body. The film cassette has a top surface from which the storage film extends and has a removable twist drive placed in the concentric hole of the cassette. The storage film extends from the film cassette, over and then down through the twist drive, down through a hole in the film cassette and into the waste container body, all in the shape of a tube. The user manually opens the lid assembly by hand and places waste such as a diaper through the twist drive and hole in the film cassette, into the storage film tube. The twist drive is then manually rotated by the user's hand, which causes the film cassette and stored film to rotate, sealing off the disposed waste in the storage film to form a packet or a pouch with a continuous twisted link still attached to the storage film. The storage film is continuously fed from the film cassette as additional links of packets or pouches are formed. The last link is then severed from the storage film when the waste receptacle has been filled to capacity. This is accomplished by closing the lid and pressing down and rotating a rotatable cutting device accessible from the top of the lid, thereby severing the film from around the rim of the film cassette, now exposed in the absence of the twist drive.

The contents of the entire prior art references cited herein are incorporated by reference. From the above it can be understood by those having ordinary skill in the art that there are a number of disadvantages associated with prior art waste disposal devices using flexible tubing and tubular sealing material to form packets for disposal of waste materials. It will also be appreciated by those skilled in the art that the steps of placing and positioning the twist drive in the device first by opening a lid, then twisting the ring to seal the waste material inside the film tube, closing the lid, then reopening the lid, closing the lid again before cutting the film may be cumbersome and time consuming. It is clear that a device is needed that will eliminate these disadvantages. Such a device should be relatively safe, economical to purchase, and easy to operate with fewer interventions by the user.

SUMMARY OF INVENTION

The present invention provides a waste disposal apparatus and a method for disposing waste material. Specifically, the present invention is directed to an apparatus having a cutting tool integrated with a mechanism for twistably sealing and cutting a tubular sealing material containing waste, deposited in such sealing waste in a tubular sealing material to form a series of waste packages, and to the use thereof. The disclosed integrated twist-and-cut (ITAC) system provides an improvement over existing waste disposal systems by eliminating intervening steps of disposing waste material.

An embodiment of the present invention comprises an integrated cutting system for a waste storage receptacle. A container body defines a waste bin. An opening provides access to the waste bin. A support in the form of a collar resides adjacent the opening. The collar has a flange extending therefrom and is cylindrically configured for mounting a film cassette above the waste bin. The collar encloses less than all of the opening to the waste bin so that waste material can be passed through the opening and into the waste bin. The invention further comprises a film cassette mounted to the flange of the collar, and a lid hingedly adjacent the collar. The lid portion encloses a first device for a film sealing means for forming waste packets by twisting a flexible film tubing that is dispensed from the film cassette. The lid portion also encloses a second device operably connected to the first device for cutting the waste packet from the film tubing.

Another embodiment of the present invention comprises an integrated cutting system for a waste storage receptacle. The waste storage receptacle has a body, a collar, a lid and a storage film cassette adapted to be positioned in the collar. The cassette has a continuous length of a tubular storage film therein. The invention further comprises a handle operably connected to the lid. The operation of the handle engages a cutting device and a film sealing device to uniform rotational motion, and twistably seals the film extending from the cassette. A button is also operably connected to the lid. The operation of the button disengages the sealing device from rotation and exposes the cutting device to the film in a stationary state. Further operation of the handle rotates a blade affixed to a blade shoe, the blade severing the film from the cassette.

Still another embodiment of the present invention involves a method for disposing waste material from a waste disposal apparatus. The method provides a lid having a sealing device and a cutting device therein. The sealing device is operable by a rotatable handle, and the cutting device by a button. A length of film tubing is provided. The tubing has a first sealed portion of the tubing at a location along its length and an open end. The method involves inserting, with the lid open, waste material through the open end of the tubing until it contacts the first sealed portion of the tubing; closing the lid; rotating the handle to rotate the sealing device and the cutting device simultaneously to only twist and seal the open end of the tubing; operating the button downwards and disengaging the sealing device; operating the rotatable handle to rotate the cutting device only, and cut the waste packet only; and discarding the waste packet from the waste disposal apparatus.

DETAILED DESCRIPTION

Referring now to FIGS. 1, 2, 3*a*-3*b* and 4*a*-4*b*, there is shown one waste disposal apparatus embodiment of the present invention utilizing an integrated twist-and-cut system for packing and disposing of waste materials.

Figure 1:
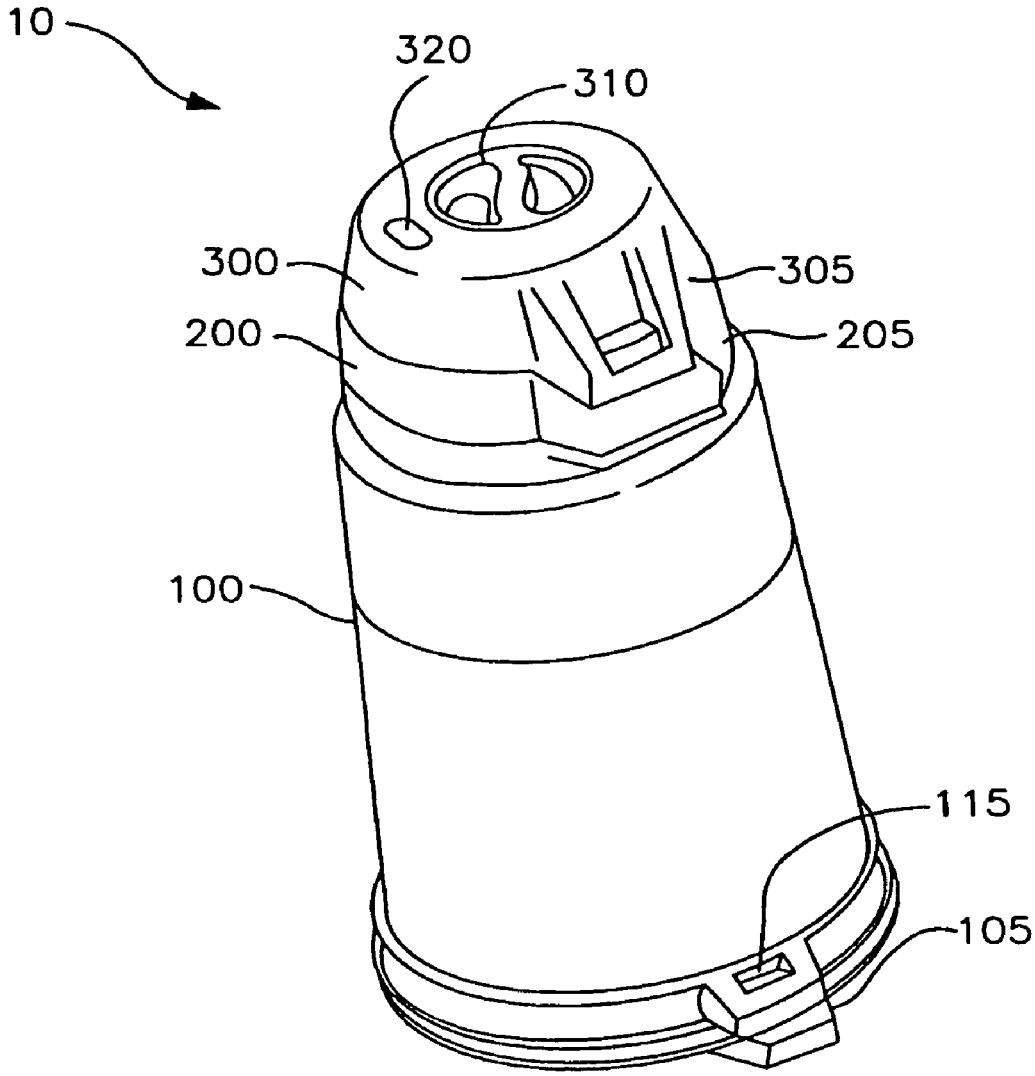
FIG. 1 is a perspective drawing of the waste disposal apparatus of the present invention showing the primary parts, including the body, collar, rotatable handle, and cutting button of the apparatus.

In FIG. 1, reference numeral 10 generally represents a waste storage and disposal apparatus having a body 100, a collar 200 and a lid 300. Body 100 serves as a receptacle for temporarily storing waste materials introduced into apparatus 10 through lid 300 and sealed in packets in the collar section 200, as will be explained more in detail with reference to FIGS. 2 and 3 below. Body 100 as shown is substantially cylindrical in shape. However, alternative shapes for body 100 can also be used including rectangular or cubical. Body 100 has a hinged base 105 and a latch 115 to lock and release the bottom base of the receptacle to provide access to stored waste products inside the receptacle. As would be understood by one of ordinary skill in the art, the hinged base 105 can be located at any other surface of body 100, such as the side.

Collar 200 is substantially cylindrical in shape and has a diameter substantially the same size as at least one the diameter of body 100 to provide a sealing engagement of the collar with the body along the conjoining portions. If an alternative shape of body 100 is used, such as rectangular or cubical, then the corresponding mating shape would also be used for collar 200 to provide a sealing engagement of the collar with the body along the conjoining portions.

Lid 300 provides the function of housing the mechanisms for the ITAC system of the present invention. The lid and the integrated twist-and-cut system therein will be described more in detail in the preferred embodiments shown in FIGS. 2, 3*a*-3*b* and 4*a*-4*b* below. Lid 300 as illustrated is also substantially cylindrical in shape and has a diameter substantially the same size as the diameter of collar 200 to provide a sealing engagement of the lid with the top along the conjoining portions. Lid 300 is pivotally connected to collar 200 by a lid hinge preferably in the rear (not shown in FIG. 1). Lid 300 has a lid slot 305 formed therein. Lid slot may comprise a button for ease of latching and unlatching. Lid slot 305 may be a unshaped channel that is operably connected to a lid latch 205 to allow user to open and close lid 300. Lid latch 205 is better seen in FIGS. 2 and 3*b* discussed below.

An aspect of an embodiment of the present invention involves a handle 310 operably interconnected to a button 320, both formed in lid 300, as shown in FIG. 1. Handle 310 is configured to be mechanically rotatable by hand. Rotatable handle 310 engages and rotates in unison a rotary twist drive 360 and a cutting tool 370. Thus, rotatable handle 310 performs not only the conventional function of forming continuous waste packets 227, such as shown in FIG. 3*b*, from a flexible film 223, but also the function of severing the packets from the film; however, without having to open the lid and performing additional steps. This is accomplished, according to the present invention, by depressing button 320 which automatically disengages the rotary twist drive 360 and continuing with the rotating action of the handle only to expose now a nonmoving, stationary flexible film 223 to a rotating cutting tool 377, such as a blade, as shown in FIGS. 2 and 3*a*.

Figure 2A:
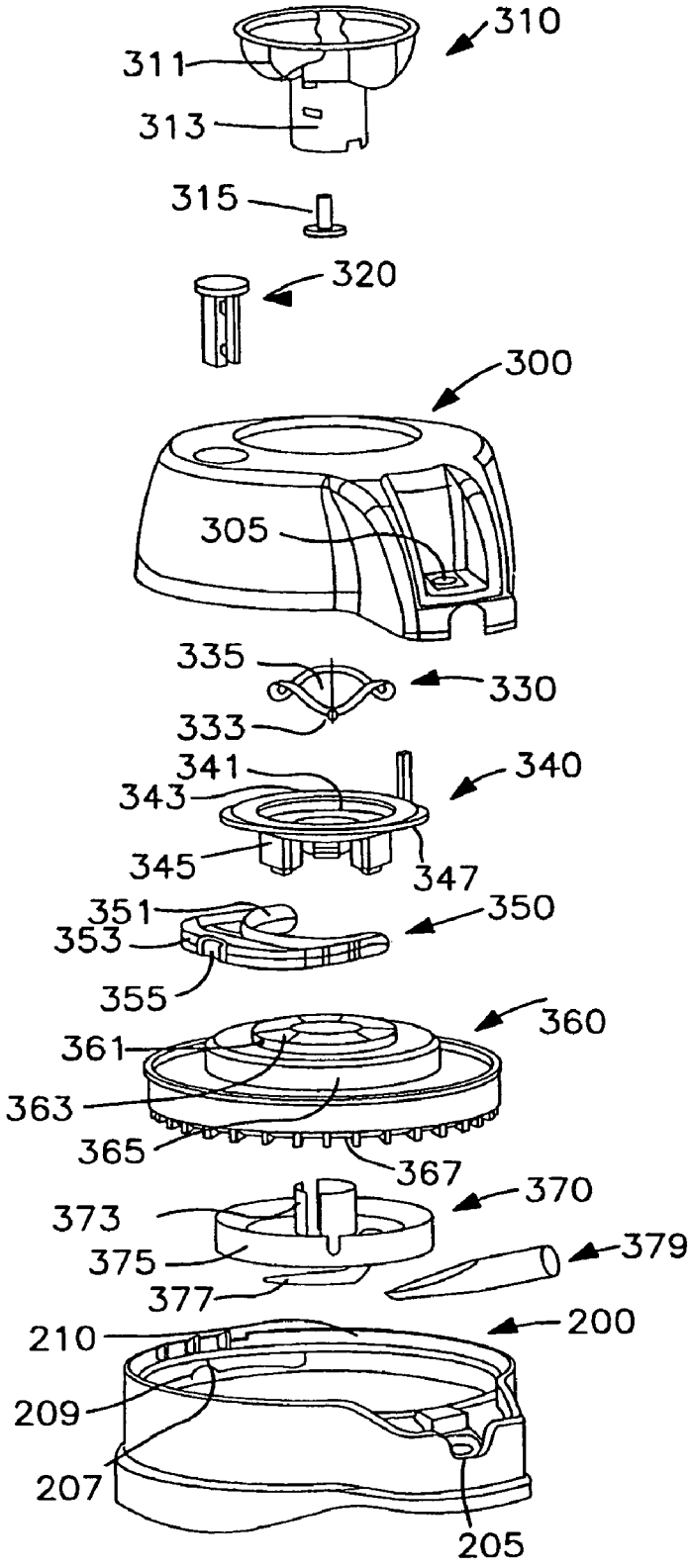
FIG. 2*a* is an exploded view showing the components of an embodiment of an integrated twist-and-cut (ITAC) system, according to the present invention.
Figure 2B:
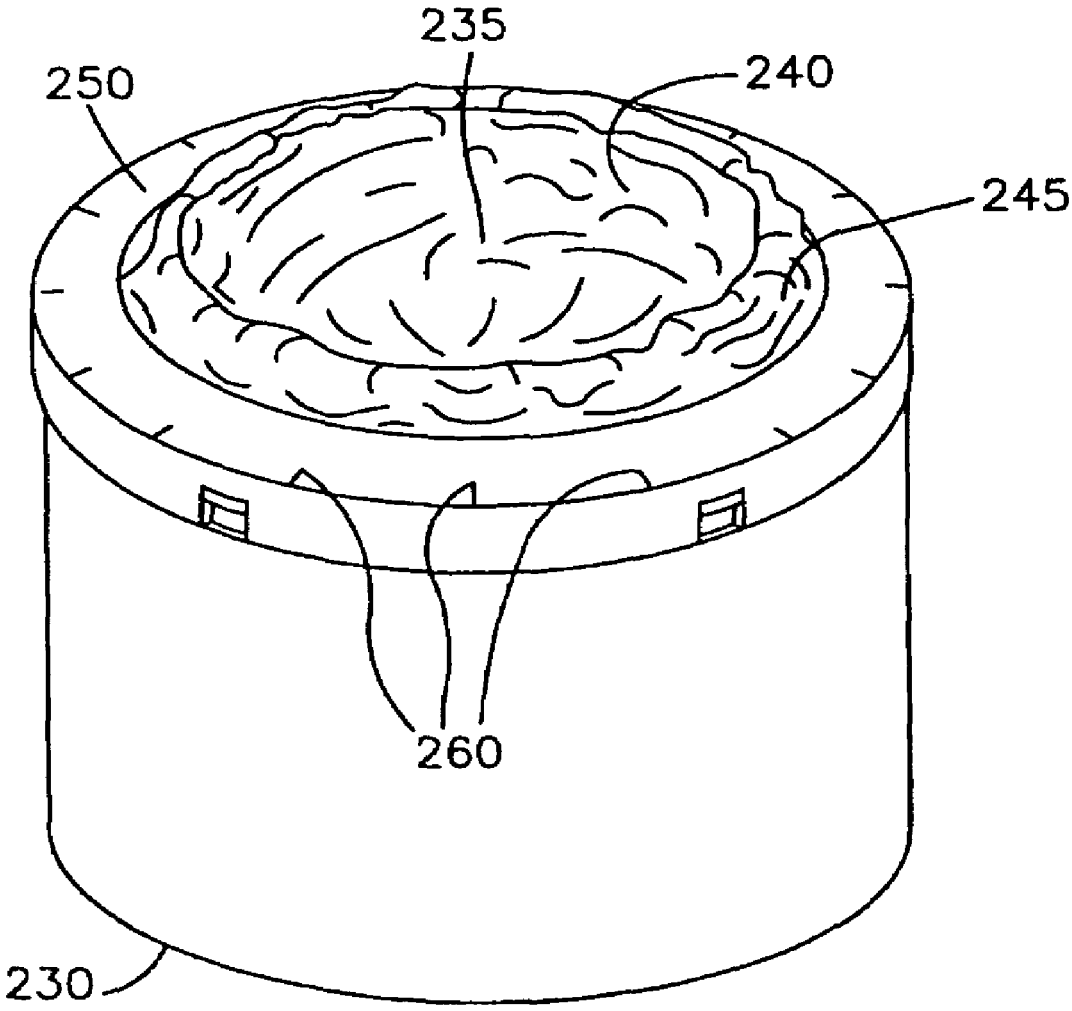
FIG. 2*b* is a schematic drawing of a tubing refill cassette, according to U.S. application Ser. No. 60/499,443.
Figure 3A:
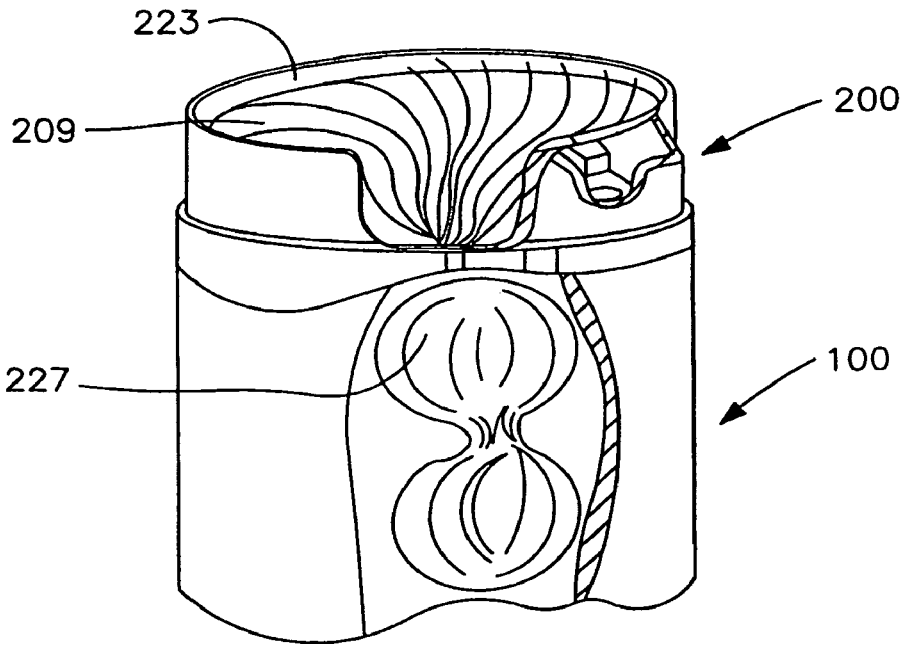
FIG. 3*a* is a partial cut-away of the apparatus of FIG. 1, showing the forming of waste packets by twisting and sealing of a flexible material, according to the present invention.
Figure 3B:
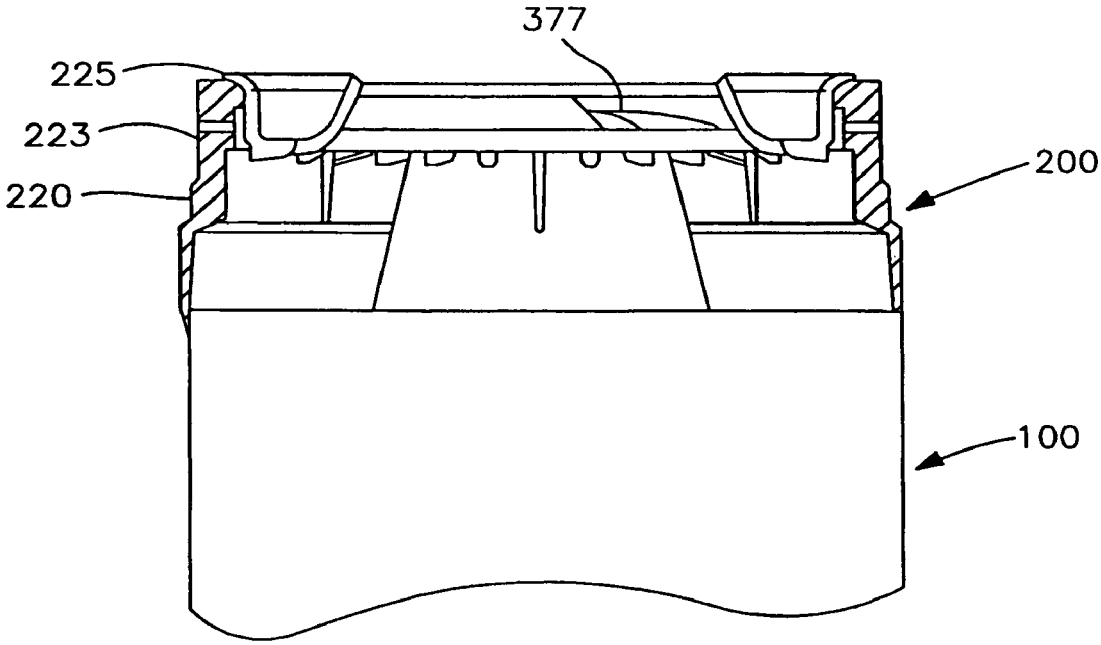
FIG. 3*b* is a cross-sectional view of the apparatus of FIG. 1, showing the placement of a film cassette in relation to a rotary twist drive and a blade shoe, according to the present invention.

Aspects of an embodiment of the present invention are shown in FIG. 2*a*, which is an exploded view of collar 200 and lid 300 of FIG. 1. Lid 300 is pivotally connected to collar 200 by a lid hinge at 207 preferably in the rear, as shown in FIG. 2*a*. Lid 300 can easily be opened or sealably closed over collar 200 by engaging or disengaging lid latch 205 to and from lit slot 305. Lid 300 is configured to house the various components of an integrated twist-and-cut, ITAC, embodiment system, including wave spring 330, clutch plate 340, yoke 350, rotary twist drive 360, and blade shoe 370, as explained below in detail, so that, when opened, the lid carries with it all the ITAC components, and provides direct access to a flange 209 of the collar where a cassette of film is placed. Cassette 220 is shown in FIG. 3.

Collar flange 209 is formed circumferentially about the inner circular wall 210 of the collar as shown in FIG. 2*a*. Circular wall 210 extends substantially vertically upward from flange 209. As used here, horizontal refers to the direction between collar latch 205 in the front and lid hinge 207 in the rear as oriented in FIG. 2*a*, which is substantially perpendicular to the sidewalls defining collar 200. Vertical refers to the direction between lid 300 and collar 200. Circular wall 210 has a diameter larger than the diameter of cassette 220 as shown in FIGS. 3*a*-3*b* and 4*a*-4*b* (not shown in FIG. 2*a*). Circular wall 210 provides support for cassette 220 to prevent it from moving in a horizontal direction yet allowing it to rotate about the center of the collar.

Referring again to FIG. 3*b*, cassette 220 stores the flexible film which emanates from the cassette through gap 225 and then fords flange 209 area (hidden underneath the film). Rotatable handle 310 then engages the rotary twist drive 360, thereby twisting the film 223 having waste material, such as a soiled diaper, garbage, etc. previously introduced into the film through the open lid, and sealing the film in a tubular form, thus sequestering the waste material in packets 227. The same rotatable handle is then used to sever, for example, the last packet from the film of the cassette when receptacle 100 is full and ready to be emptied by releasing latch 105 in FIG. 1.

In one embodiment of the present invention shown in the exploded view in FIG. 1, rotatable handle 310 has a substantially round upper portion 311 and a cylindrical neck 313 which extends through all the openings centrally formed in the components of the ITAC system, in the order starting from lid 300, wave spring 330, clutch plate 340, yoke 350, rotary twist drive 360 and engages shoulder 373 of blade shoe 370. Handle 310 is, therefore, capable of imparting rotational motion directly to blade shoe 370 with rim 375. In one embodiment, it is preferred that the engagement of neck 313 to shoulder 373 is in the form of a split spline as shown in FIG. 2*a*, although it will be understood by those skilled in the art that the engagement of the neck to the shoulder can be accomplished in different ways, including a press fit neck into a sleeve.

In an embodiment of an aspect of the invention, wave spring in FIG. 2*a* comprises an undulating shape with opening 335, and the undulating portions press upon the upper portion of lid 300 (not shown) when inserted about the neck 313. The bottom surface of the wave spring has protrusions 333 as shown in the same Figure. It will be understood that springs of other shapes, including types of protrusions other than shown in FIG. 2*a* can also be used. Protrusions 333 of the wave spring press against corresponding recesses (not shown) formed in a lower surface of clutch plate 340 shown in FIG. 2*a*. Clutch plate 340 has an upper surface 341 in the form of a ring with geared teeth 343. Teeth 343 engage rotatably with teeth located in lid 300 (not shown) when button 320 is depressed. The clutch plate locks the rotary twist drive 360 in place when button 320 is pressed.

In another embodiment of an aspect of the invention, clutch plate 340 has a plurality of vertical projections 345 formed on its lower surface, as shown in FIG. 2*a*. Vertical projections 345 of clutch plate 340 engage in corresponding openings 363 that are formed in rotary twist drive 360 shown in FIG. 2*a*. In operation, any rotational motion imparted by handle 310 is transmitted to the blade shoe 370, which is operably connected to the handle via neck 313 of the handle. In turn, vertical projections 345 of the clutch plate transmit the rotational motion to the rotary twist drive 360. It will be noted in FIG. 2*a* that the blade shoe 370 nests inside the dome-like cavity 365 under the rotary twist drive 360, wherein blade 377 (there may be two or more blades although only one is shown in the diagram) is positioned coplanarly with ribbed surface 367 of the rotary twist drive. FIG. 2*a*, therefore, shows an embodiment which may be employed in an aspect of the invention, wherein the rotation of handle 310 provides zero, or stationary, relative motion between the rotary twist drive 360 and the blade shoe 370, thereby providing only a twisting action of the film 223 on the rim 250 of the cassette 230 shown in FIGS. 2*b* and 3*a* to seal refuse previously deposited into the film, and form packets 227. The cassette rim 250 contains ribs 260 (FIG. 2*b*) that allow the twist drive teeth to engage it and rotate it.

A tubing refill cassette is shown in FIG. 2*ab* as cited in U.S. application Ser. No. 60/499,443. A rotary grip ring or a rotary twist drive may be used to rotate the cassette body 230 effectively twisting the flexible tubing 240 which emanates through a gap 245 between rim 250 of cassette 230 and the open cassette core area 235, and is folded down through the open cassette core area 235 into an interior bin space. The bottom rim 230 of the film cassette rests on several glide buttons that are affixed, for example, to the flange support which may be affixed to the internal wall side of a waste bin. Glide buttons alleviate friction between the bottom of cassette body 230 and the surface it rests on, and allow the refill to freely rotate in the body 100.

Figure 4A:
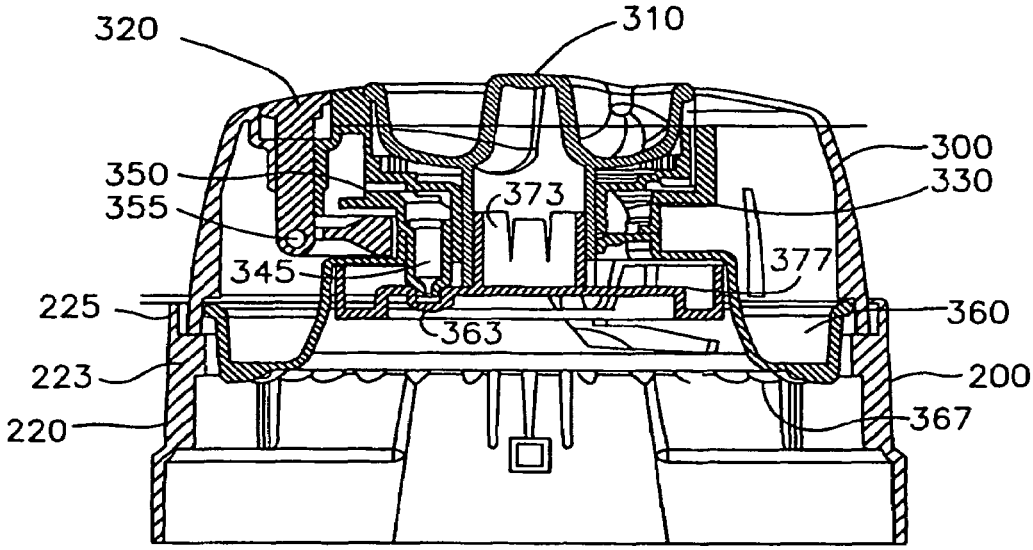
FIG. 4*a* is a partial cross-sectional view of the apparatus of FIG. 1, showing the position of the components of the ITAC system in twist mode, only.

Another aspect of the present invention involves a yoke 350 positioned between clutch plate 340 and rotary twist drive 360. Yoke 350 is generally unshaped having lateral projections 351 and a curvilinear shoulder 353, as shown in FIG. 2*a*. In assembly, lateral projections 351 straddle vertical projections 345 of clutch plate 350 and slidably press against the lower surface 347 of the clutch plate. The curvilinear portion of shoulder 353 protrudes beyond the periphery of the clutch plate 340 to accommodate the seating of a button 320 in a recess 355 on the shoulder of the yoke, without interference by the clutch plate. Button 320 is operably connected to lid 300, and is better seen in FIGS. 4*a* and 4*b*. In its normal position, that is, when the button is not depressed as seen in FIG. 4*a*, vertical projections 345 can rotate freely in between lateral projections 351 when set into motion by rotating handle 310, thus also rotating the rotary twist drive 360, as described above. Rotary twist drive 360 has a drive collar 361 with a plurality of openings 363 corresponding to the plurality of clutch plate projections 345 which engage the openings to rotate the rotary twist drive 360. FIG. 4*a* shows a cross-sectional view of the positions of the components of the ITAC system in the twist mode, only.

An embodiment of an aspect of the present invention provides a means for lifting the clutch plate vertically and disengaging the vertical projections 345 of the clutch from openings 363 in the rotary twist drive 360, thereby allowing only the blade shoe 370 to rotate when set into motion by rotating handle 310 and sever the flexible film 223 from the rim of the cassette, as shown in FIGS. 3*a* and 3*b*. This function is provided by button 320, which, when depressed, causes the shoulder 353 of the yoke to move downward, while moving the lateral projections 351 upwards to lift the clutch plate 340. It will be noted that in the absence of any twisting action, flexible film 223 in FIGS. 3*a* and 3*b* remains stationary, and hence the relative motion between the blades 377 and film 223 will cut the film. Although it may be preferred that a pair of diametrically opposed blades be used along the periphery of the circular blade shoe 370 of the invention, it will be understood by workers in the field that any plurality of various shapes of blades can also be used.

Figure 4B:
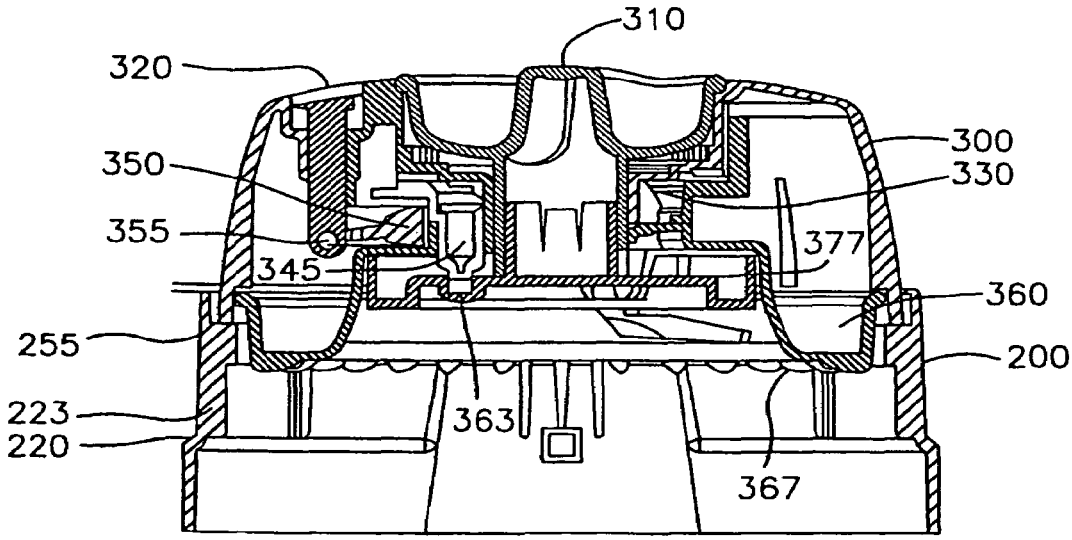
FIG. 4*b* is a partial cross-sectional view of the apparatus of FIG. 1, showing the position of the components of the ITAC system in cut mode, only.

FIG. 4*b* shows a cross-sectional view of the positions of the various components of the ITAC system in the cut mode, only. Specifically, it will be noted that button 320 is pushed downwards into lid 200, and yoke 350 is tilted so that vertical projections 345 of clutch 340 are lifted out of the recesses 363 of the rotary twist drive 360.

While the invention has been particularly shown and described with reference to particular embodiments, those skilled in the art will understand that various changes in form and details may be made without departing form the spirit and scope of the invention. For example, the handle and button operations can be automated. Furthermore, an indent can be provided for the button so that one need not hold down both the button and the handle during the cutting operation. Also, a number of clicks can be incorporated to the turning of the rotatable handle to signal positively the end of twisting of the film material in forming waste packets. In addition, a sighting can be provided to show the waste bin reaches the full capacity. Cutting blade shown in FIG. 2*a* can also be made replaceable for ease to the user as depicted by blade cartridge 379 in the same FIG. 2*a*.

What is claimed is:

1. A waste storage device comprising:

a container defining a waste bin and an opening that provides access to the waste bin;

a collar mounted on the container adjacent the opening, the collar including a body with a flange extending therefrom that is circumferentially configured for holding a film cassette above the waste bin, wherein the body encloses less than all of the opening to the waste bin so that waste material can be passed through the opening and into the waste bin, the film cassette being positionable on the flange, the film cassette having a rim defining an open core, wherein a tubular film is dispensed from the rim; and a lid hingedly mounted to the collar, a first device mounted in the lid for selectively sealing the tubular film for forming a waste packet that is dispensed from the film cassette; and a second device mounted in the lid operably connected to the first device for cutting the waste packet from the tubular film.

2. The waste storage device of claim 1, wherein the waste packet is formed by twisting the tubular film that is dispensed from the film cassette.

3. The waste storage device of claim 1, wherein the film cassette is rotationally interacted to the flange in the body.

4. The waste storage device of claim 1, wherein the first device further comprises a rotary twist drive engageable with the film cassette.

5. The waste storage device of claim 4, wherein the first device further comprises a clutch with extended projections engaging the rotary twist drive.

6. The waste storage device of claim 5, wherein the first device further comprises a rotatable handle which drives the clutch operationally connected to a blade shoe.

7. The waste storage device of claim 6, wherein the first device further comprises a spur gear operationally configured to permit the handle to be rotated in only one direction.

8. The waste storage device of claim 4, wherein the second device further comprises a button which disengages the rotary twist drive from the film cassette and exposes rotating cutting tools in a blade shoe to severe the film from the stationary cassette.

9. A waste storage device comprising:

a receptacle body;

a collar;

a lid;

a storage film cassette adapted to be positioned in the receptacle body, wherein the storage film cassette has a continuous length of storage film therein;

a cutting device;

a film sealing device;

a handle operably connected to the lid, wherein operation of the handle engages the cutting device and the film sealing device to move and seal the storage film extending from the storage film cassette;

a button operably connected to the lid, wherein actuation of the button disengages the sealing device from movement and exposes the cutting device to the storage film in a stationary state; and a blade affixed to the cutting device, wherein the operation of the handle moves the blade with respect to the storage film to sever the storage film from the storage film cassette when the button is actuated.

10. The waste storage device of claim 9, wherein the lid is adapted to receive the handle through a first opening formed in a central region of the lid.

11. The waste storage device of claim 9, wherein the button is positioned in a second opening formed peripherally on the lid.

12. The waste storage device of claim 9, wherein the collar is fitted circumferentially below the lid.

13. The waste storage device of claim 9, wherein the handle has an upper portion and a lower portion, wherein the upper portion of the handle is configured to be mechanically rotatable by hand, and wherein the lower portion of the handle extends centrally into the lid.

14. The waste storage device of claim 13, wherein the lower portion of the handle extends through a wave spring positioned between the upper portion of the handle and a clutch plate having an upper surface and a lower surface.

15. The waste storage device of claim 14, wherein the upper surface of the clutch plate forms a geared ring about a centrally located opening, and wherein the lower surface of the clutch plate has a plurality of vertical projections on the opposite side of the geared ring.

16. The waste storage device of claim 15, wherein the lower portion of the handle extends through the vertical projections and through a yoke formed to capture the periphery of the lower surface of the clutch plate, wherein the yoke is formed to have a circumferential shoulder and unshaped lateral projections, wherein the lateral projections of the yoke surround the protruding vertical projections of the clutch plate, and wherein the shoulder of the yoke extends beyond the geared ring of the clutch plate.

17. The waste storage device of claim 16, wherein the shoulder of the yoke operably communicates with the button, wherein the button when pressed downward engages the shoulder of the yoke downwardly causing the lateral projections of the yoke to move upward and lift the clutch plate against the wave spring, wherein the sealing device comprises a rotary twist drive, and wherein the cutting device comprises a rotary blade shoe having blades affixed thereto.

18. A method for disposing waste material from a waste disposal apparatus, comprising:

providing a lid having a sealing device and a cutting device therein, the sealing device being operable by a movable handle, and the cutting device being operable by a button;

providing a length of tubing having a first sealed portion of the tubing at a location along a length thereof and an open end of the tubing;

inserting waste material, with the lid open, through the open end of the tubing until it contacts the first sealed portion of the tubing;

closing the lid;

operating the movable handle to move the sealing device and the cutting device simultaneously to only move and seal the open end of the tubing to form a waste packet;

actuating the button to disengage the sealing device; and operating the handle to move the cutting device only to cut the waste packet only.

19. The method of claim 18, wherein the operation of the handle engages the cutting device and the sealing device causing uniform rotational motion, and twistably seals the tubing extending from a cassette.

20. The method of claim 19, wherein the actuation of the button disengages the sealing device from rotation and exposes the cutting device to the tubing in a stationary state, and cuts the tubing.

21. A waste storage device comprising:

a container defining a waste bin and an opening that provides access to the waste bin;

a collar mounted on the container adjacent the opening, the collar including a body with a flange extending therefrom that is circumferentially configured for holding a film cassette above the waste bin, the film cassette having a rim defining an open core, wherein a tubular film is dispensed from the rim; and a lid hingedly mounted to the collar, a first device mounted in the lid for selectively sealing the tubular film for forming a waste packet that is dispensed from the film cassette; and a second device mounted in the lid operably connected to the first device for cutting the waste packet from the tubular film.

* * * * *